US007048135B2

(12) United States Patent
Smyers et al.

(10) Patent No.: US 7,048,135 B2
(45) **Date of Patent: *May 23, 2006**

(54) INWARDLY FOLDING CONTAINER

(75) Inventors: Justin M. Smyers, Redondo Beach, CA (US); Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 132 days.

This patent is subject to a terminal disclaimer.

(21) Appl. No.: 10/265,894

(22) Filed: Oct. 7, 2002

(65) Prior Publication Data

US 2003/0042255 A1 Mar. 6, 2003

Related U.S. Application Data

(63) Continuation of application No. 09/942,210, filed on Aug. 29, 2001, now Pat. No. 6,460,717.

(51) Int. Cl.
*B65D 6/18* (2006.01)

(52) U.S. Cl. ..... 220/6

(58) Field of Classification Search ..... 220/6, 220/7

See application file for complete search history.

(56) References Cited

U.S. PATENT DOCUMENTS 1,496,466 A * 6/1924 Jackson ..... 16/260
3,941,271 A 3/1976 Zarges et al.
3,970,209 A 7/1976 Baxter
4,163,495 A 8/1979 Drader
4,186,841 A 2/1980 Buckley et al.
4,735,330 A 4/1988 Hoss
5,515,987 A 5/1996 Jacques et al.
5,538,153 A 7/1996 Marovskis et al.
5,938,059 A 8/1999 Luburic
5,975,324 A 11/1999 Schmitt
6,460,717 B1 10/2002 Smyers et al.
6,631,822 B1 * 10/2003 Overholt ..... 220/7

FOREIGN PATENT DOCUMENTS

| | | |
|---|---|---|
| DE | 2352533 | 4/1975 |
| EP | 0 895 941 | 2/1999 |
| FR | 2 272 907 | 12/1975 |
| WO | WO 98/34838 | 8/1998 |
| WO | WO 02/34630 | 5/2002 |

* cited by examiner

*Primary Examiner*—Stephen Castellano

(57) ABSTRACT

A folding crate or container is provided having a translating hinge arrangement that allows a side wall of the crate to freely translate in a vertical direction when rotated into a folded position. By allowing opposing side walls to move vertically relative to a bottom component of the crate when folded, subsequent overlapping side walls will lay substantially flat and parallel to the bottom component when folded thereon. This in turn allows the overall height of the crate to be reduced when in the folded position without requiring a specific side wall folding sequence.

31 Claims, 7 Drawing Sheets

INWARDLY FOLDING CONTAINER

CROSS-REFERENCE TO RELATED APPLICATION

This is a continuation of application Ser. No. 09/942,210 filed on Aug. 29, 2001 now U.S. Pat. No. 6,460,717.

BACKGROUND OF THE INVENTION

1. Field of the Invention

The present invention relates to foldable crates suitable for holding and transporting objects.

2. Background Art

Folding crates are generally known in the art. Typical folding crate arrangements connect each side wall to a bottom surface via a hinge arrangement. When not in use, opposing side walls can be folded down onto the bottom surface to significantly reduce the space requirement of the crate.

Depending on the overall size of the crate, it is common for two side walls to have a height greater than half the width of the bottom surface so that only one of the side walls will lie flat on the bottom surface, while the opposing side wall will overlap and lie on top thereof. This causes the overlying side wall to be in a final nonparallel folded position relative to the bottom surface, i.e., an angle of incidence greater than zero. Thus, the overall height or "nest increment" of the folded crate is significantly increased by the angled, overlapping side wall when in the folded position.

One known approach for allowing the folded walls to lie parallel to the bottom surface, and thereby reduce the height of a folded crate, involves positioning the hinges of opposing side walls at different heights. However, such asymmetrical arrangements require the side walls to be folded in a specific sequence, which in turn increases complexity and convenience in handling the crate. In addition, the asymmetrical hinge layout can present additional issues associated with tooling or molding of the crate. Another known approach involves forming the overlapping side walls with faces that align and intermesh when folded. Again, such an approach can increase the complexity in handling the crate, and may not even be practical for crates having side walls that overlap by a significant amount.

Therefore, a need exists for a folding crate having a reduced nest increment which does not require a specific side wall folding sequence, and can be employed with crates having side walls that substantially overlap.

SUMMARY OF THE INVENTION

Accordingly, one aspect of the present invention is to provide a folding crate having a hinge arrangement that allows a side wall to freely translate in a vertical direction upon folding so that the side wall will be generally parallel relative to a bottom component and a subsequently folded side wall and thereby substantially reduce the folded height of the crate without requiring a specific side wall folding sequence.

In accordance with this and other aspects, the present invention provides a folding crate including a side wall having a hinge pin, and a bottom component having a means for rotatably supporting the hinge pin to allow the side wall to be folded over the bottom component. The bottom component also includes a vertically extending slot formed therein. The hinge pin includes a portion thereof arranged to move within the slot when the side wall is in a folded position, thereby allowing the side wall to translate vertically into a position substantially parallel to the bottom component.

In accordance with another aspect of the present invention, a folding crate is provided including a side wall having a hinge pin, and a bottom component having a vertically extending slot formed therein, and a stationary hinge pin retainer arranged to support rotation of the hinge pin therein to allow the side wall to be folded over the bottom component. The hinge pin includes a portion thereof arranged to move within the slot upon the pin being rotated into a predetermined position relative to the bottom component so that the side wall can translate vertically into a position substantially parallel to the bottom component.

In accordance with still another aspect of the present invention, a folding crate is provided having a plurality of side walls each having a hinge arranged to allow the side wall to rotate and translate vertically, and a bottom component connected to each hinge. Because each hinge allows the side wall to translate vertically, any one of the side walls can be folded first so that the hinge will allow the wall to translate vertically. The hinge of a subsequently folded side wall will allow the side wall to fold over the previously folded side wall in a position substantially parallel relative thereto to reduce the overall folded height of the crate.

The above aspects and other aspects, features, and advantages of the present invention are readily apparent from the following detailed description of the preferred embodiment(s) when taken in connection with the accompanying drawings.

DETAILED DESCRIPTION OF THE PREFERRED EMBODIMENT(S)

Figure 1:
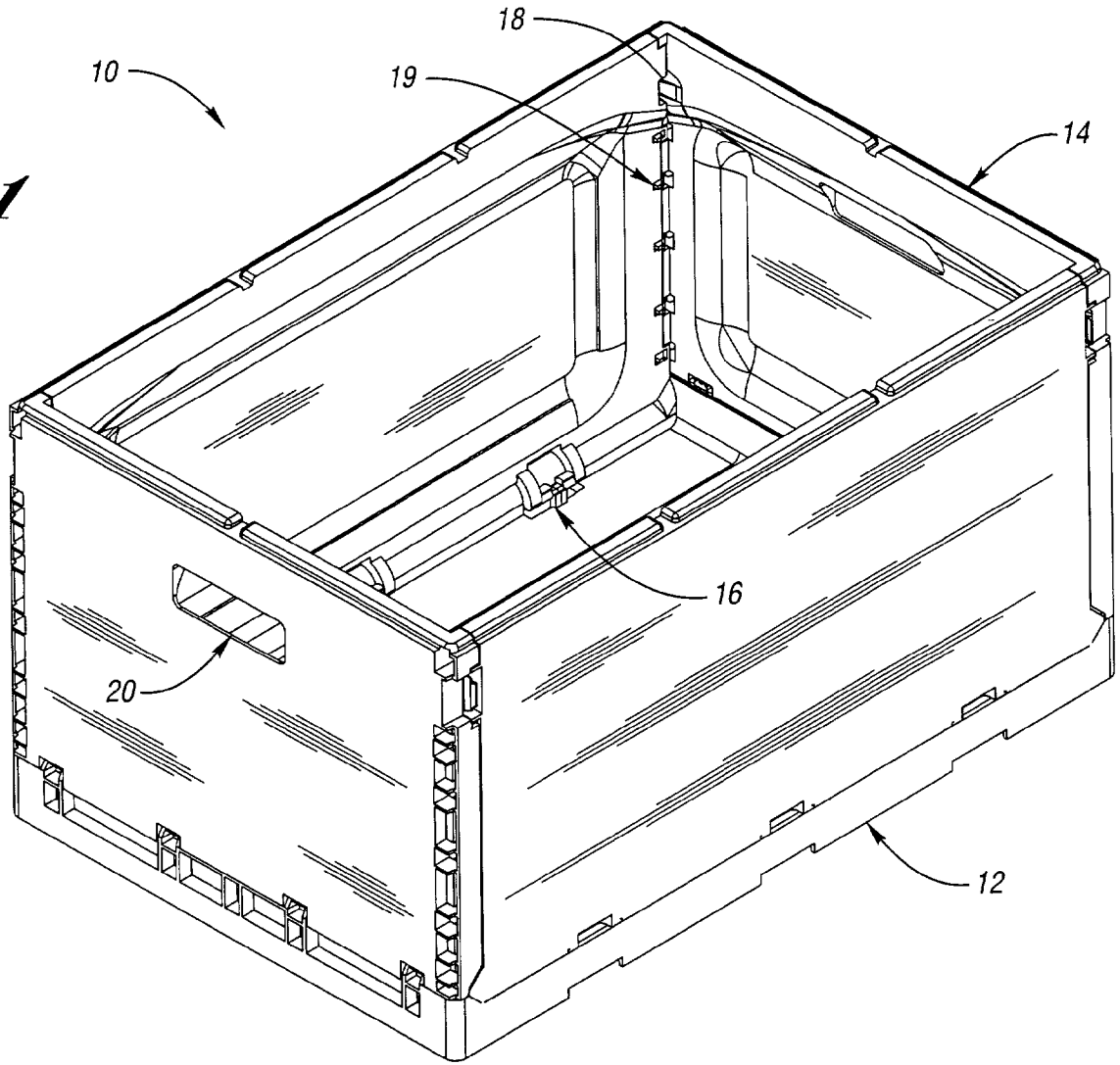
FIG. 1 is an elevational perspective view of a crate in accordance with a first exemplary embodiment of the present invention.
Figure 2:
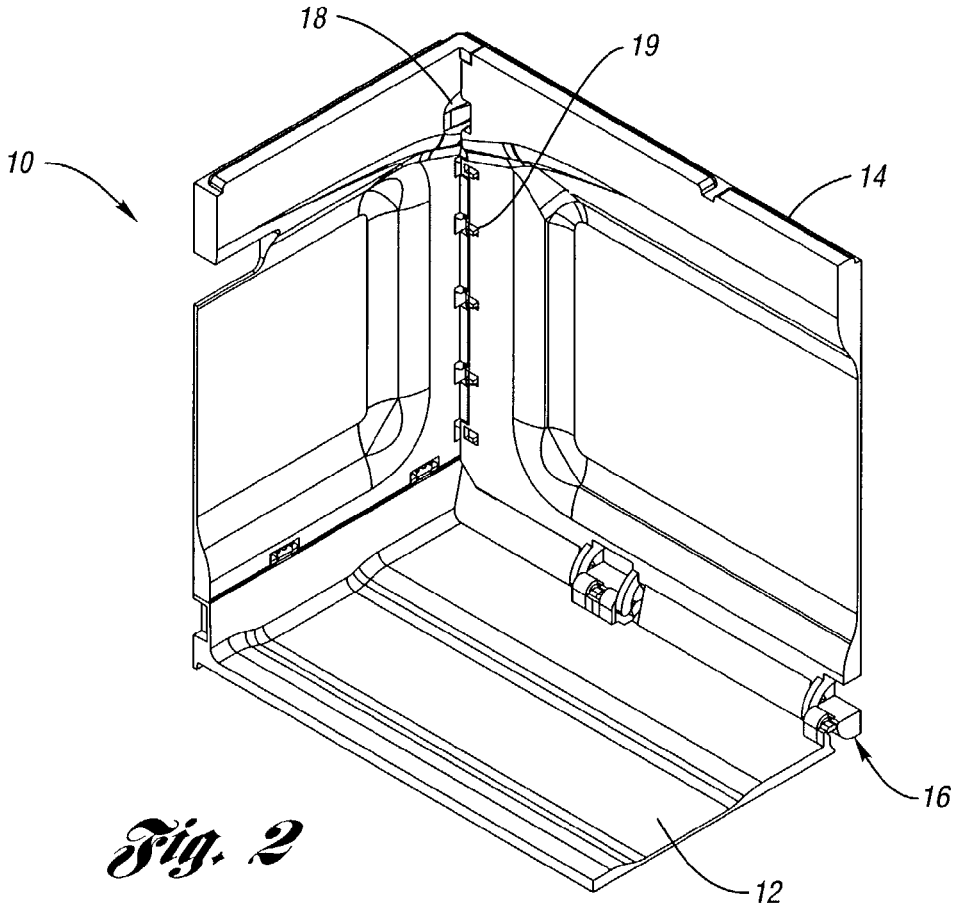
FIG. 2 is a partial elevational perspective view of the inside of the crate of FIG. 1 showing a long wall and an end wall.

Referring to FIGS. 1–5, a folding crate 10 is shown in accordance with a first, exemplary embodiment of the present invention. Crate 10 includes a bottom component 12 coupled to each of four side wall components 14 via a translating hinge arrangement 16 described more fully below. Thus, each side wall component 14 can be folded down inwardly across the bottom component 12 so as to be substantially parallel therewith. When erected, the side walls 14 form an enclosure with the bottom component 12. Adjacent side walls can be latched together in the erected position with any suitable latch or fastening mechanism arrangement. An interlocking arrangement 18 is shown for illustrative purposes, where one adjoining side wall includes a flexible latch arm integrally formed therewith which aligns with and engages a corresponding opening formed in the other adjoining side wall. However, such an arrangement is not to be construed as limiting. In addition, a set of vertically positioned guide elements 19 can be provided on each side wall to facilitate proper alignment of the side walls when raised.

The bottom component 12 and side wall components 14 of crate 10 can be injection molded from a thermoplastic material. In this exemplary embodiment, crate 10 is arranged in an open-top box configuration having a generally rectangular shape. However, the present invention can be applied to any type and shape of folding crate. Thus, the precise configuration shown in the Figures is not to be construed as limiting. As further shown, two or more side wall components 14 can include a handle or opening 20 formed therein. In addition, while not shown in the drawings, at least a portion of the bottom component and/or side walls can be formed having a pattern of holes or other openings for ventilation, weight reduction, etc.

Figure 3:
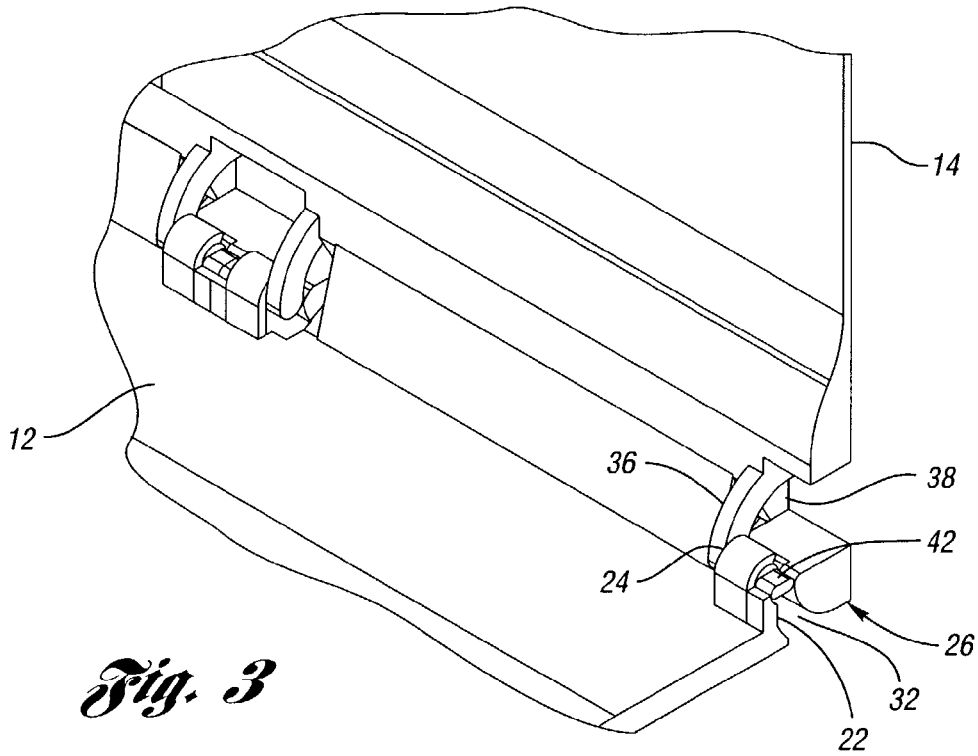
FIG. 3 is an enlarged view of a portion of FIG. 2 showing a full translating hinge arrangement and a center line section through another translating hinge arrangement.
Figure 4:
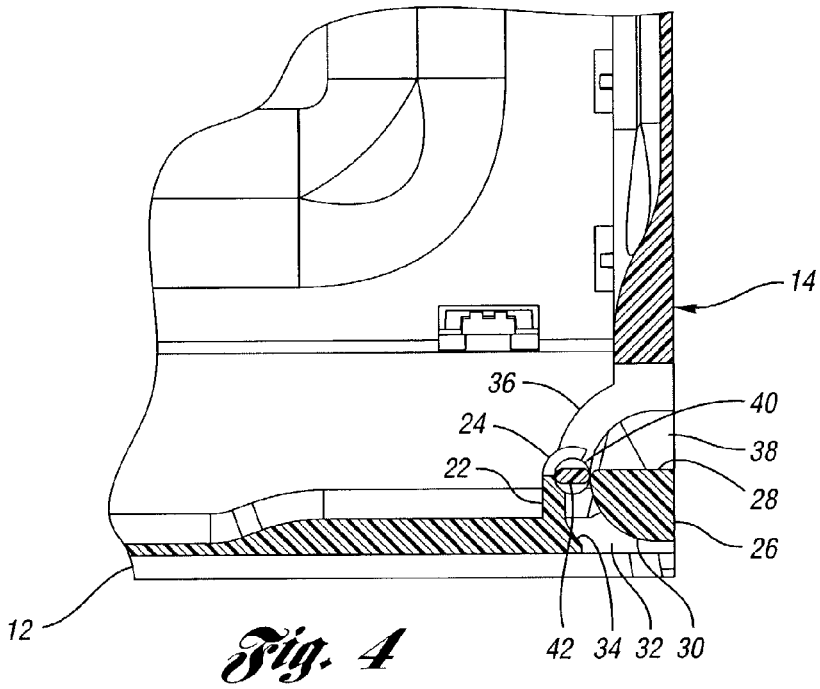
FIG. 4 is a side view cross-section showing the hinge arrangement in accordance with the first embodiment.
Figure 5:
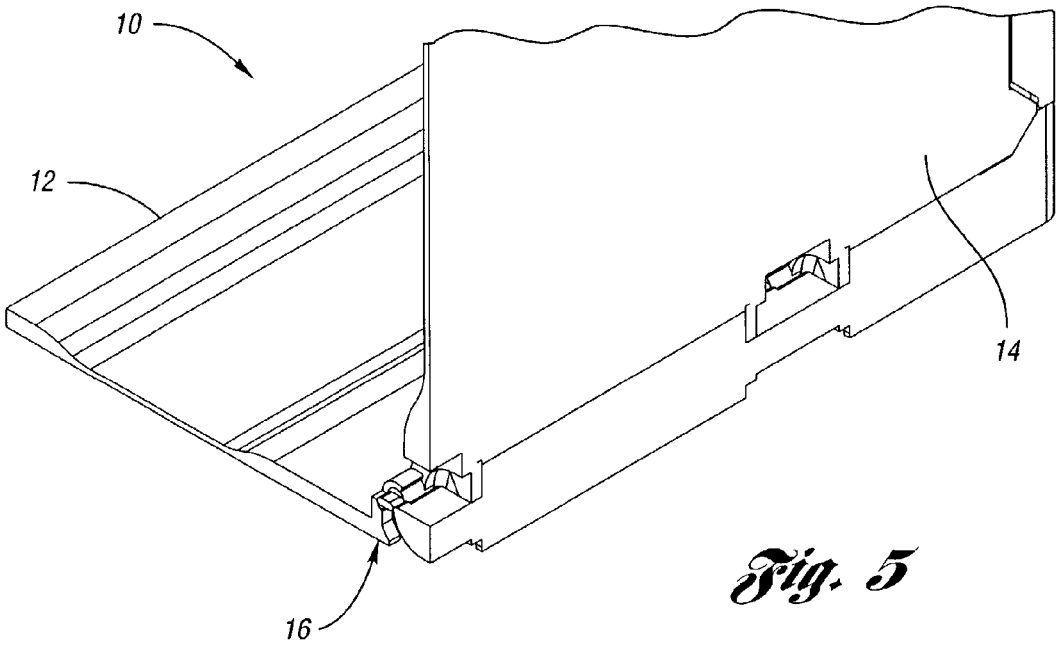
FIG. 5 is a partial elevational perspective view of the outside of the crate of FIG. 1.

Referring now more specifically to FIGS. 3 and 4, in accordance with this embodiment, hinge arrangement 16 includes a stationary member 22 having a curved hinge pin retainer 24 extending from at least a portion thereof, and a stop member 26 having a substantially parallel surface 28 and a curved surface 30. Both members 22 and 26 are integrally formed as part of bottom component 12. Stationary member 22 and stop member 26 are positioned relative to each other so as to form a vertically extending slot 32 defined by curved surface 30 and a partially arcuate surface 34 on stationary member 22. In the embodiments shown, slot 32 extends downwardly and outward in an arcuate path.

Hinge arrangement 16 also includes a corresponding pivot arm 36 and stop heel 38 extending from the bottom edge of the side wall component 14. The pivot arm 36 includes a horizontally extending hinge pin 40 integrally formed therewith. Hinge pin 40 has a generally cylindrical shape arranged to fit within hinge pin retainer 24 and rotate therein to allow the side wall component to be folded downward over the bottom component 12.

Figure 6:
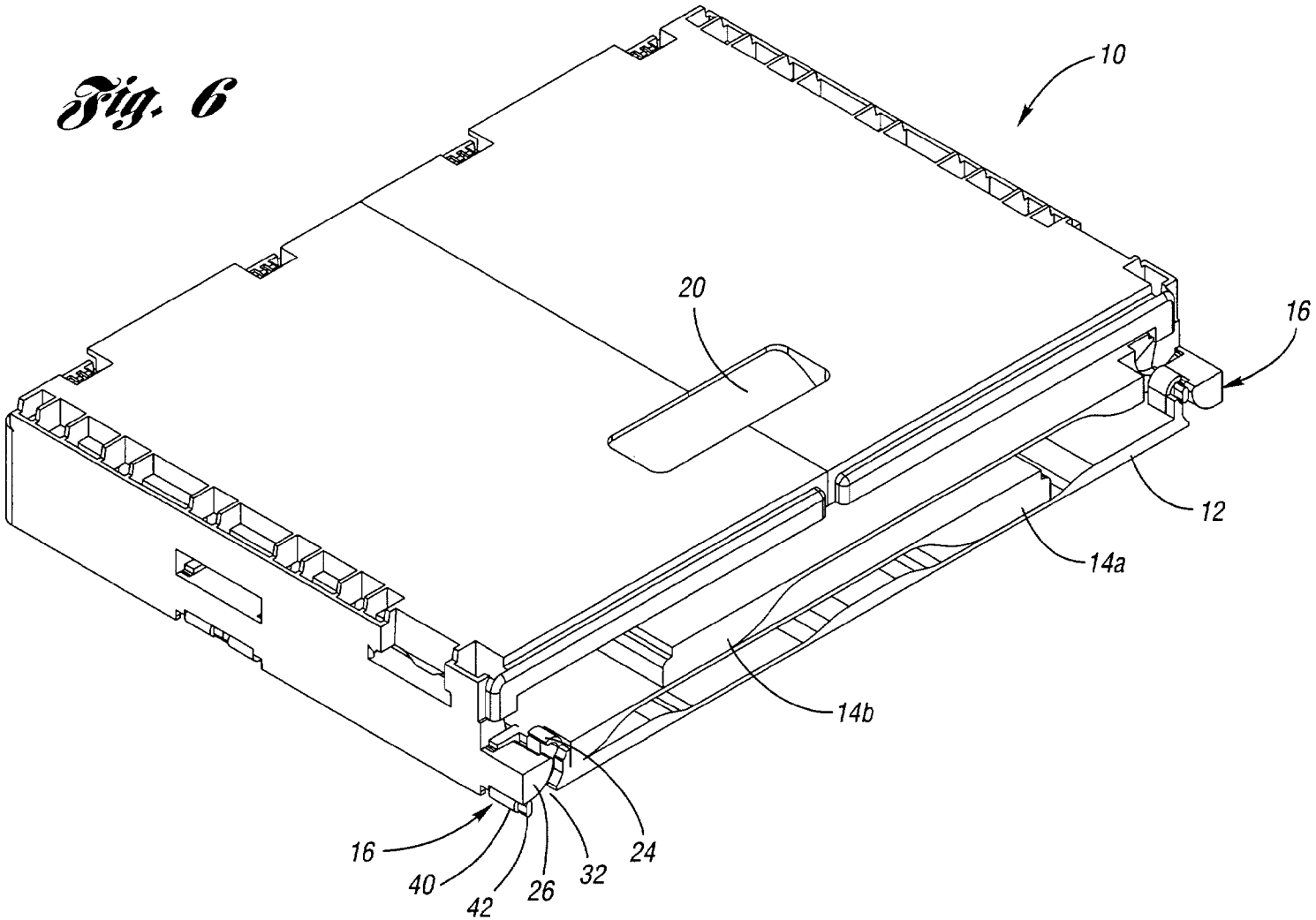
FIG. 6 is an elevational perspective cross-section of two long walls and an end wall when in the folded position.
Figure 7:
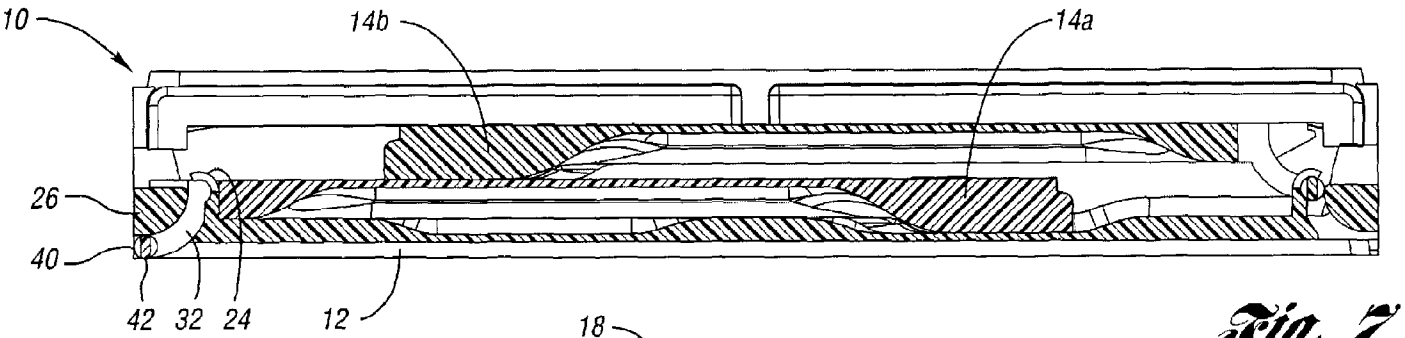
FIG. 7 is an end view of FIG. 6 taken in the direction indicated by arrow A—A.
Figure 8:
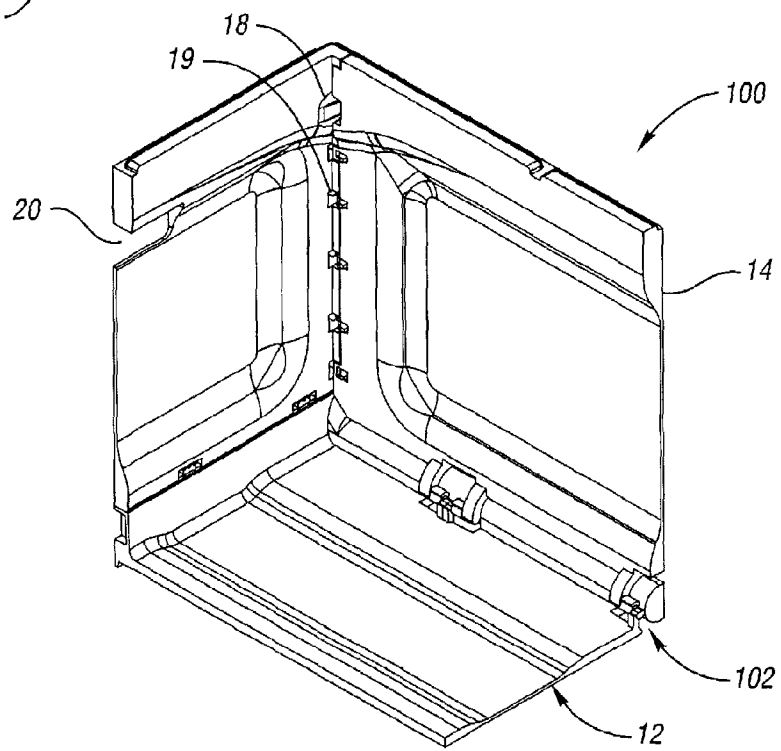
FIG. 8 is a partial elevated perspective view of the inside of the crate in accordance with a second exemplary embodiment of the present invention.
Figure 9:
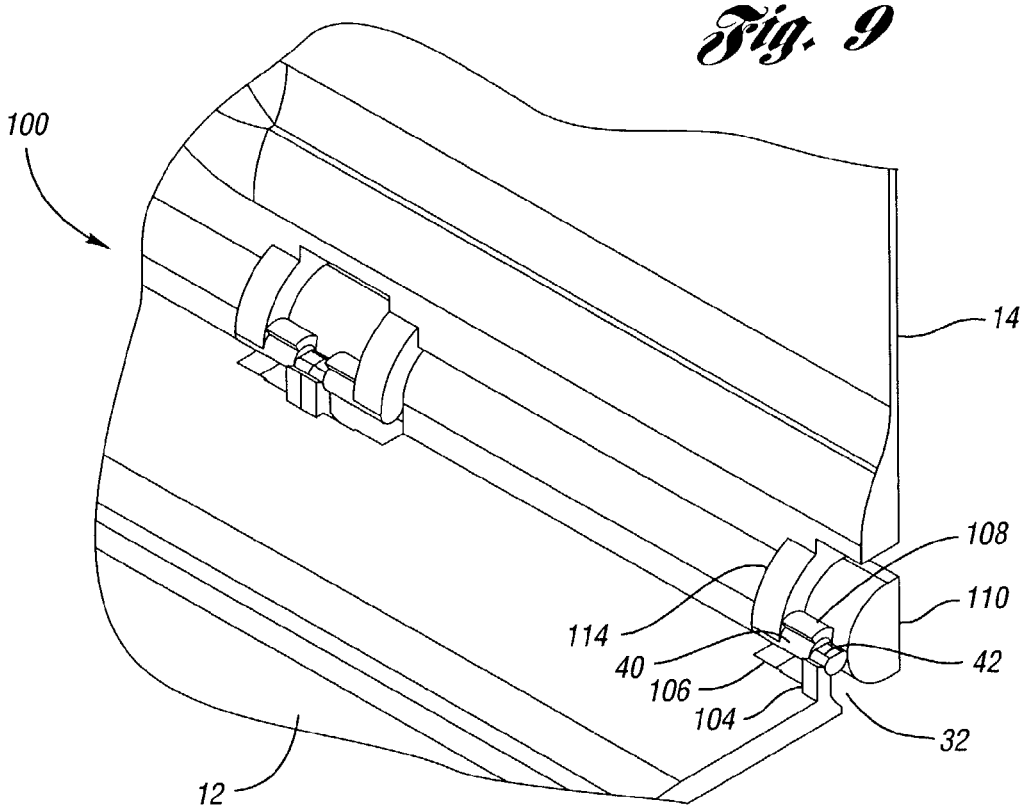
FIG. 9 is an enlarged view of a portion of FIG. 7 showing a translating hinge arrangement in accordance with the second embodiment of the present invention.

Hinge pin 40 includes at least one selected portion thereof formed by substantially truncating or flattening the cylindrical circumference of pin 40. The selected portion or portions can be located at the end of the hinge pin 40. However, this is not to be construed as limiting. The flattened portion(s) form a cam-like member on the pin 40. More specifically, a non-flattened portion of the outer end surface of the hinge pin 40 supports pivoting within hinge pin retainer 24 as the side wall component is rotated up or down. The substantially flattened portion or portions of pin 40 are oriented relative to slot 32 so that rotation of the pin 40 aligns the flattened portion(s) with the top opening of slot 32 when the side wall component 14 has been folded into a substantially parallel position relative to the bottom component. When so positioned, the entire hinge pin 40 is able to freely slide within slot 32. As pin 40 slides down slot 32, the side wall component 14 is able to freely translate in a vertical direction, e.g., downward and outward, when folded so as to lay in a position substantially parallel to the bottom component 12. As seen in FIGS. 6 and 7, the translating hinge arrangement of the present invention allows a side wall component 14*a* to translate vertically by an amount sufficient to allow a subsequently folded side wall component 14*b* to lie substantially parallel when folded over the previously folded wall, thereby effectively reducing the overall height of the folded crate. In addition, because each side wall includes a translating hinge, opposing side walls do not need to be folded in a specific sequence relative to each other.

In addition, as the side wall component 14 is erected, a bottom surface of stop heel 38 will come to rest on flat surface 28 of stop member 26 to prevent any further upward rotation of the side wall component when the side wall is substantially perpendicular to the bottom component 12 of the crate. This accomplished by positioning flat surface 28 relative to hinge pin 40 so as to be in alignment with the center of rotation thereof. Heel 38 also provides structural support for the side wall to reduce potential load forces placed on hinge arrangement 16 when the crate has been unfolded.

Figure 10:
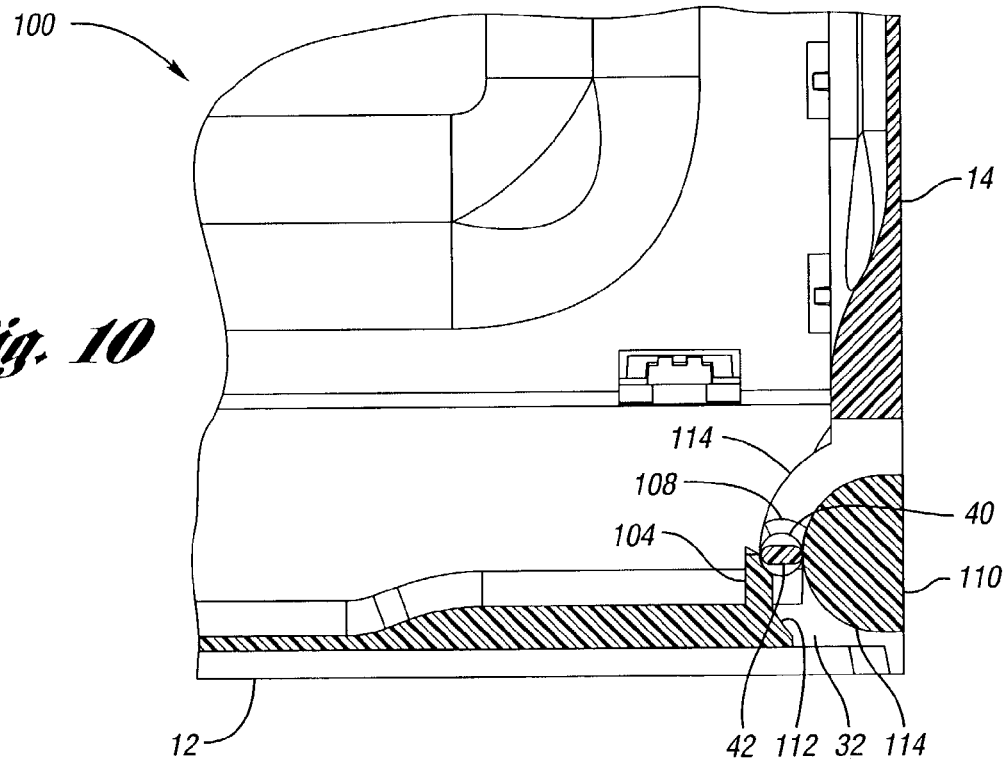
FIG. 10 is a side view cross-section showing the hinge arrangement in accordance with the second embodiment.
Figure 11:
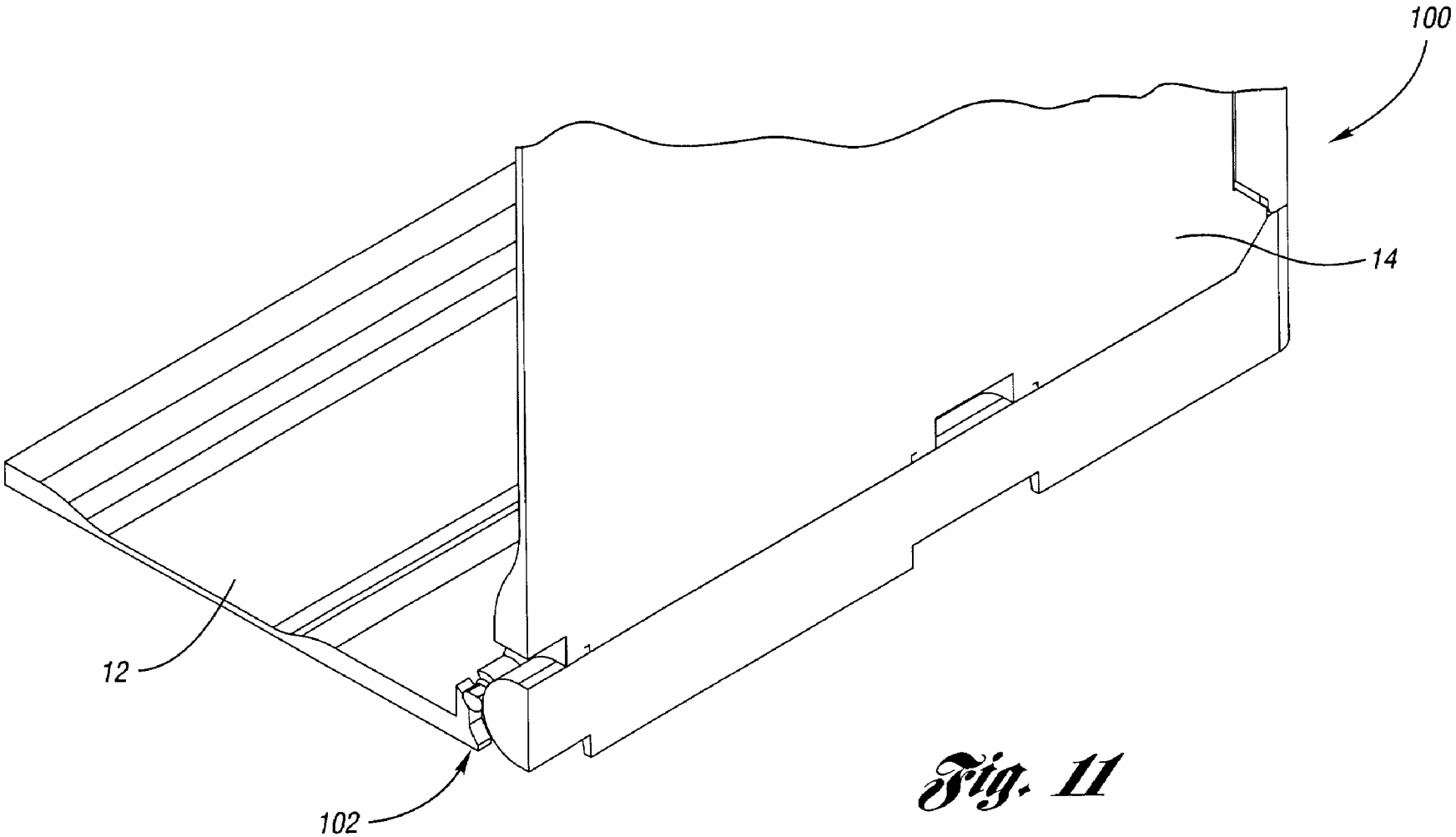
FIG. 11 is a partial elevational perspective view of the outside of the crate of FIG. 8.

Referring now to FIGS. 8–11, a second exemplary crate embodiment 100 is shown in accordance with the present invention having a translating hinge arrangement 102 used to allow the side wall component 14 to move vertically when rotated into the folded position. More specifically, as best seen in FIG. 10, hinge arrangement 102 includes an upwardly extending post member 104, a stationary member 106 having a curved hinge pin retainer 108 extending therefrom, and an arcuate stop member 110, all of which are integrally formed as part of bottom component 12. Appenadage 104 and stop member 110 are positioned relative to each other so as to form the vertically extending slot 32 defined by the curved surface of member 110 and a partially arcuate surface 112 on post member 104.

Hinge arrangement 102 also includes a corresponding pivot arm 114 extending from the bottom edge of the side wall component 14. Flattened end 42 of hinge pin 40 extends horizontally from pivot arm 114, and is arranged to fit within hinge pin retainer 108 and rotate therein to allow the side wall component 14 to be folded downward over the bottom component 12.

As with crate 10, the flattened portion of pin end 42 allows the entire hinge pin 40 to slide down slot 32 when the side wall component is substantially parallel to the bottom component, i.e., when the flattened portion is aligned and oriented with the top opening of slot 32. As pin 40 slides down slot 32, the side wall component 14 translates vertically into a position substantially parallel to the bottom component, thereby allowing a subsequently folded side wall to lie substantially parallel when folded down on top thereof.

In this embodiment, as the side wall component 14 is erected, a bottom surface of pivot arm 114 will come to rest on the outer curved surface of arcuate stop member 108 to prevent any further upward rotation of the side wall component. The center point of the radius of stop member 108 is positioned relative to hinge pin 40 so as to be in alignment with the center of rotation thereof. In addition, the distance between the center of rotation of pin 40 and the center point of stop 108 is equal to the thickest portion of the side wall component 14 so that pivot arm 114 will properly nest with stop member 108 when the side wall is the erect position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A folding crate comprising:

a side wall;

a bottom component;

a hinge connection between the side wall and the bottom component including a hinge pin rotatably supported adjacent a vertically extending slot, the hinge pin including a cam portion with a major dimension larger than a width of the slot and a minor dimension less than the width of the slot; and a support adjacent the slot, the support including a support surface adjacent an opening to the slot, wherein the cam portion is supported on the support surface when the side wall is in an unfolded position generally perpendicular to the bottom component, the support surface partially defining the opening to the slot.

2. The folding crate of claim 1 wherein the support surface is concave.

3. The folding crate of claim 2 wherein the cam portion of the hinge pin comprises at least one flattened portion in an outer circumference of the hinge pin so that the hinge pin is supported by the support as the side wall is erected perpendicular to the bottom component, and is slidable to a position within the slot at which the side wall is parallel to the bottom component.

4. The folding crate of claim 1 wherein the cam portion of the hinge pin is formed at an end of the hinge pin.

5. The folding crate of claim 1 further including a stop member arranged to stop rotation of the side wall upon erecting the side wall into an unfolded position.

6. The folding crate of claim 5 wherein the side wall further comprises a stop heel formed thereon, said stop heel positioned on the side wall so as to contact a surface of the stop member when the side wall is substantially perpendicular to the bottom component.

7. The folding crate of claim 1 wherein the hinge pin is integrally formed with the side wall.

8. The folding crate of claim 1 wherein the cam portion is positioned in the slot when the side wall is in a fully collapsed position when the side wall is resting directly on one of the bottom component and another collapsed side wall.

9. The folding crate of claim 1 wherein the cam portion is positioned in the slot when the side wall is in a fully collapsed position.

10. A folding crate comprising:

a side wall;

a bottom component;

a hinge connection between the side wall and the bottom component including a hinge pin rotatably supported adjacent a vertically extending slot, the hinge pin including a cam portion with a major dimension larger than a width of the slot and a minor dimension less than the width of the slot, the cam portion positioned in the slot when the side wall is in a fully collapsed position;

a stop member arranged to stop rotation of the side wall upon erecting the side wall into an unfolded position, wherein the stop member comprises a curved surface having a center point in alignment with a center of rotation of the hinge pin; and a stop heel formed on the side wall, said stop heel positioned on the side wall so as to contact a surface of the stop member when the side wall is substantially perpendicular to the bottom component.

11. The folding crate of claim 10 wherein the side wall further comprises a pivot arm formed thereon, said pivot arm positioned on the side wall so as to nest with the curved surface of the stop member when the side wall is substantially perpendicular to the bottom component.

12. A folding crate comprising:

a side wall;

a bottom component;

a hinge connection between the side wall and the bottom component including a hinge pin rotatably supported adjacent a vertically extending slot not perpendicular to the bottom component, the hinge pin including a cam portion with a major dimension larger than a width of the slot and a minor dimension less than the width of the slot, wherein the slot is arcuate, such that the cam portion travels in an arcuate path in the slot when the cam portion is in the slot and the side wall is pivoted to a collapsed position;

a support for supporting the hinge pin; and a stop member arranged to stop rotation of the side wall upon erecting the side wall into an unfolded position, the support comprising a stationary post member positioned relative to the stop member so as to form the slot between the post member and the stop member.

13. A folding crate comprising:

a sidewall;

a bottom component; and a hinge connection between the side wall and the bottom component including a hinge pin supported adjacent a vertically extending slot, the hinge pin having a flattened portion, a surface of the flattened portion extending generally transverse to the slot when the side wall is an unfolded position generally perpendicular to the bottom component and generally aligned with the slot when the side wall is rotated toward a position generally parallel to the bottom component, wherein the flattened portion can be positioned in the slot when the side wall is in a fully collapsed position.

14. The folding crate of claim 13 wherein the flattened portion has a major dimension larger than a width of an opening to the slot and a minor dimension less than the width of the opening to the slot.

15. The folding crate of claim 14 wherein the major dimension is larger than the opening to the slot.

16. The folding crate of claim 15 wherein the major dimension is generally transverse to the slot when the side wall is in the unfolded position.

17. The folding crate of claim 13 further including a support adjacent the slot, the support including a support surface adjacent an opening to the slot.

18. The folding crate of claim 17 wherein the cam portion is supported on the support surface when the side wall is in the unfolded position.

19. The folding crate of claim 18 wherein the support surface is concave.

20. The folding crate of claim 19 wherein the flattened portion of the hinge pin comprises at least one flattened surface in the hinge pin outer circumference so that the hinge pin is supported by the support as the side wall is erected perpendicular to the bottom component, and is slidable to a position within the slot at which the side wall is parallel to the bottom component.

21. The folding crate of claim 20 wherein the cam portion of the hinge pin is formed at an end of the hinge pin.

22. The folding crate of claim 21 further including a stop member arranged to stop rotation of the side wall upon erecting the side wall into the unfolded position.

23. The folding crate of claim 13 wherein the flattened portion can be positioned in the slot when the side wall is in the fully collapsed position resting directly on one of the bottom component or another collapsed side wall.

24. A folding crate comprising:

a bottom component;

at least two side walls movable between an unfolded position generally transverse to the bottom component and a folded position generally parallel to the bottom component; and a hinge connection between each of the at least two side walls and the bottom component, at least one of the hinge connections including a hinge pin rotatably supported adjacent a vertically extending arcuate slot, the hinge pin including a cam portion with a major dimension larger than a width of the slot and a minor dimension less than the width of the slot.

25. The folding crate of claim 24 wherein the major dimension is larger than an opening to the slot.

26. The folding crate of claim 25 wherein the major dimension is generally transverse to the slot when the side walls are in the unfolded position.

27. The folding crate of claim 26 further including a support adjacent the slot, the support including a support surface adjacent the opening to the slot.

28. The folding crate of claim 27 wherein the cam portion is supported on the support surface when the side wall is in the unfolded position generally perpendicular to the bottom component.

29. A folding crate comprising:

a side wall having a pivot arm;

a bottom component;

a hinge connection between the side wall and the bottom component including a hinge pin rotatably supported adjacent a vertically extending slot, the hinge pin including a cam portion with a major dimension larger than a width of the slot and a minor dimension less than the width of the slot; and a stop member arranged to stop rotation of the side wall upon erecting the side wall into an unfolded position, said pivot arm positioned on the side wall so as to nest with a curved surface of the stop member when the side wall is in a fully upright position.

30. The folding crate of claim 29 wherein the curved surface of the stop member has a center point in alignment with a center of rotation of the hinge pin.

31. The folding crate of claim 30 wherein the side wall includes a stop heel positioned so as to contact a surface of the stop member when the side wall is in the fully upright position.

* * * * *